US010760372B2

(12) United States Patent
Scruggs et al.

(10) Patent No.: US 10,760,372 B2
(45) Date of Patent: Sep. 1, 2020

(54) HIGH EXPANSION WELL TOOL AND ASSOCIATED METHODS

(71) Applicant: WEATHERFORD TECHNOLOGY HOLDINGS, LLC, Houston, TX (US)

(72) Inventors: Justin R. Scruggs, Houston, TX (US); Gary D. Ingram, Richmond, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/224,993

(22) Filed: Dec. 19, 2018

(65) Prior Publication Data

US 2020/0199965 A1 Jun. 25, 2020

(51) Int. Cl.
*E21B 33/12* (2006.01)
*E21B 33/128* (2006.01)

(52) U.S. Cl.
CPC ..... *E21B 33/1208* (2013.01); *E21B 33/128* (2013.01)

(58) Field of Classification Search
CPC ..... E21B 33/1208; E21B 33/128
See application file for complete search history.

(56) References Cited

U.S. PATENT DOCUMENTS 3,702,634 A 11/1972 Anderson et al.
6,772,844 B2 8/2004 Lloyd et al.
8,973,667 B2 3/2015 Hedrick
2010/0270035 A1* 10/2010 Ring ..... E21B 29/10 166/384
2017/0159401 A1* 6/2017 Saltel ..... E21B 33/1216

FOREIGN PATENT DOCUMENTS

EP 2118552 B1 4/2013
GB 2296520 A 3/1996

OTHER PUBLICATIONS

International Search Report and Written Opinion dated Mar. 23, 2020 for International Application No. PCT/US20/063976, 12 pages.

* cited by examiner

*Primary Examiner* — Taras P Bemko
*Assistant Examiner* — Yanick A Akaragwe
(74) *Attorney, Agent, or Firm* — Smith IP Services, P.C.

(57) ABSTRACT

A well tool can include an annular seal and a radial expansion mechanism having radially retracted and radially expanded configurations, the annular seal being longitudinally displaceable relative to the radial expansion mechanism in the radially retracted configuration. A method of setting a well tool can include positioning the well tool in a well, the well tool including an annular seal and a radial expansion mechanism, and then longitudinally displacing the annular seal to a radially outward position relative to the radial expansion mechanism. A well system can include a well tool including an annular seal, a radial expansion mechanism, an inner mandrel assembly and a setting sleeve, and a setting tool that produces a relative longitudinal displacement between the setting sleeve and the inner mandrel assembly, the annular seal radially outwardly overlying the radial expansion mechanism in response to the relative longitudinal displacement.

17 Claims, 14 Drawing Sheets

HIGH EXPANSION WELL TOOL AND ASSOCIATED METHODS

BACKGROUND

This disclosure relates generally to equipment utilized and operations performed in conjunction with a subterranean well and, in an example described below, more particularly provides a high expansion well tool and associated methods.

A well plug may be used to isolate one section of a wellbore from another section, either permanently or temporarily. If temporary isolation is desired, the well plug may be retrievable from the wellbore. Typically, a well plug includes an annular seal for sealing off an annulus between the wellbore and a body of the plug, and an anchoring device (such as one or more slips) for securing the plug against displacement in the wellbore.

A well packer is typically similar to a well plug, in that a well packer can include an annular seal and an anchoring device. However, a well packer is typically provided with an interior longitudinal flow passage that permits flow through the packer and any tubular string connected to the packer. Note that the terms "plug" and "packer" are not mutually exclusive, since some plugs provide for selective flow therethrough, and some packers have provisions for selectively blocking flow therethrough.

It will, therefore, be appreciated that improvements are continually needed in the arts of designing, constructing and utilizing plugs and packers for subterranean wells.

DETAILED DESCRIPTION

Figure 1:
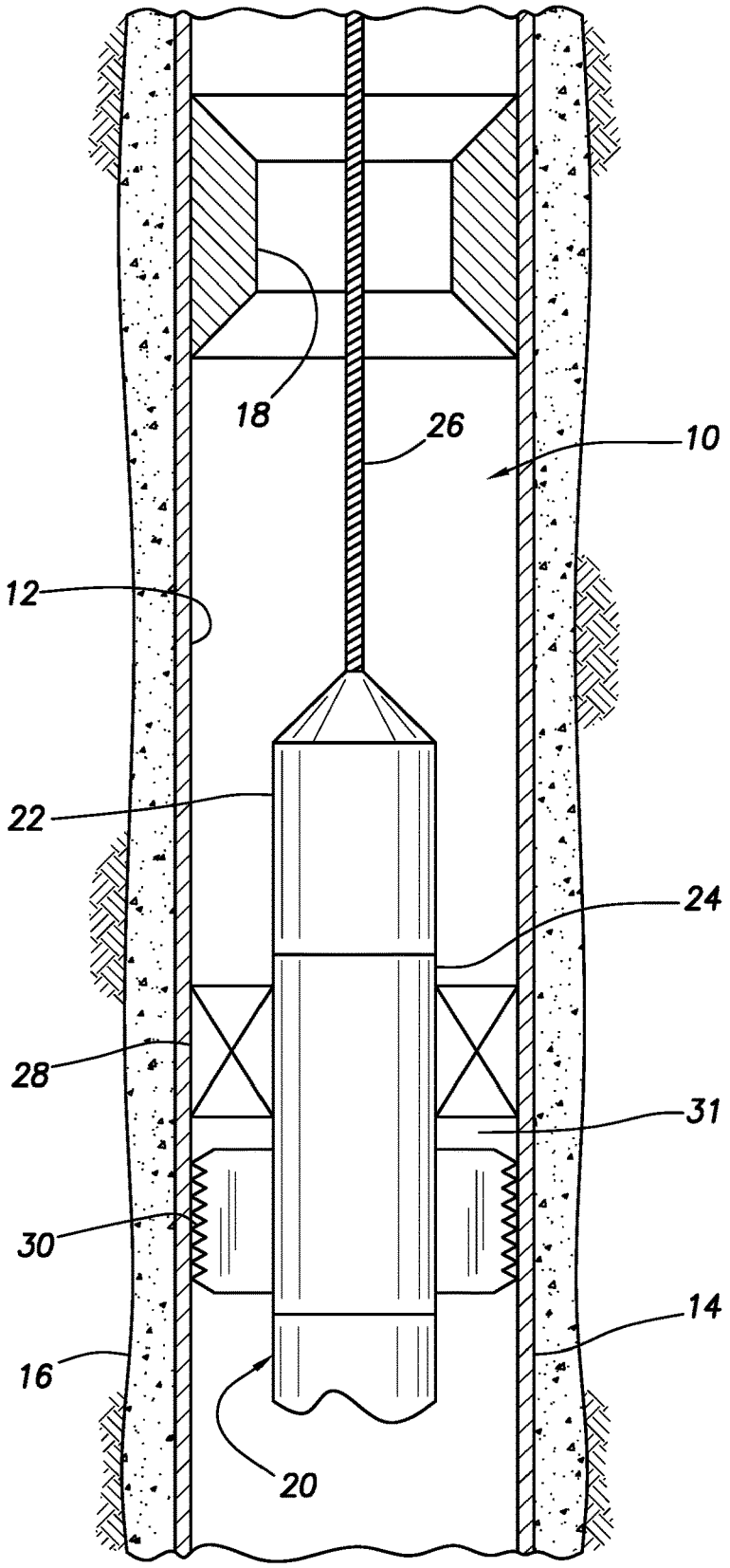
FIG. 1 is a representative partially cross-sectional view of an example of a well system and associated method which can embody principles of this disclosure.

Representatively illustrated in FIG. 1 is a well system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is lined with casing 14 and cement 16. In other examples, a portion of the wellbore 12 in which the principles of this disclosure are practiced may be uncased, unlined or "open hole."

As depicted in FIG. 1, there is a restriction 18 in the wellbore 12. In this example, the restriction 18 is a reduced inner diameter, that is, an inner diameter less than an inner diameter of the casing 14 on either side of the restriction. For example, the restriction 18 could comprise a nipple or reduced diameter seat, an interior portion of a casing valve or other well tool, a casing patch, etc. In other examples, the restriction 18 could comprise an obstruction other than a reduced inner diameter (such as, a partial casing collapse or other casing damage, etc.).

Thus, the scope of this disclosure is not limited to any particular type of restriction, or to the presence of a restriction at all.

It is desired in the FIG. 1 example to isolate a lower portion of the wellbore 12 from an upper portion of the wellbore. This isolation is to be accomplished at a location below or further downhole from the restriction 18. For this purpose, a bottom hole assembly 20 is introduced into the wellbore 12.

In the FIG. 1 example, the bottom hole assembly 20 includes a setting tool 22 and a well tool 24. The bottom hole assembly 20 is conveyed into the wellbore 12 by a wireline, slickline, electric line, coiled tubing or other type of conveyance 26. In other examples, the bottom hole assembly 20 could include other or different tools (such as, a casing collar locator, etc.), and a conveyance may not be used for positioning the bottom hole assembly in the wellbore 12 (for example, fluid flow could be used to convey the bottom hole assembly to a desired location).

The well tool 24 in the FIG. 1 example is of the type referred to by those skilled in the art as a "bridge plug." After setting the well tool 24 in the wellbore 12, a portion of the wellbore downhole from the well tool will be fluid- and pressure-isolated from a portion of the wellbore uphole from the well tool. However, in other examples, the well tool 24 could be of the type referred to by those skilled in the art as a "packer." Thus, the scope of this disclosure is not limited to use of any particular type or configuration of well tool.

As depicted in FIG. 1, the well tool 24 includes an annular seal 28 and an anchor mechanism 30. The annular seal 28 is radially extendable from the well tool 24 downhole to thereby sealingly engage an inner surface of the wellbore 12. In this manner, the annular seal 28 prevents fluid flow through an annulus 31 formed radially between the well tool 24 and the wellbore 12.

The anchor mechanism 30 is outwardly extendable from the well tool 24 downhole to thereby grippingly engage the inner surface of the wellbore 12. In this manner, the anchor mechanism 30 secures the well tool 24 against longitudinal displacement relative to the wellbore 12.

Note that it is not necessary for the well tool 24 to include the anchor mechanism 30, or for the anchor mechanism to be separate from the annular seal 28. For example, the sealing engagement between the annular seal 28 and the wellbore 12 could also provide sufficient gripping engagement to secure the well tool 24 against longitudinal displacement, or the anchor mechanism 30 could be integral with the annular seal. Thus, the scope of this disclosure is not limited to any particular components, combination of components or configuration of the well tool 24.

In the FIG. 1 example, the well tool 24 must pass through the restriction 18, in order to be positioned at the desired location for setting the well tool. The annular seal 28 and the anchor mechanism 30 cannot extend too far outward from the well tool 24, so that they prevent the well tool from passing through the restriction 18, but the annular seal and the anchor mechanism must be capable of extending sufficiently far outward from the well tool when it is desired for the annular seal to sealingly engage the wellbore 12, and for the anchor mechanism to grippingly engage the wellbore.

If there is a relatively large inner dimensional difference between the wellbore 12 and the restriction 18, this means that the annular seal 28 and the anchor mechanism 30 must be capable of a corresponding relatively large outward extension from the well tool 24 after the well tool has passed through the restriction 18. In addition, if the well tool 24 is to be subsequently retrieved from the wellbore 12, the annular seal 28 and the anchor mechanism 30 must be capable of a corresponding relatively large inward retraction when desired, so that the well tool can pass back through the restriction.

Referring additionally now to FIGS. 2A-F, cross-sectional views of an example of the well tool 24 that may be used in the system 10 and method of FIG. 1 are representatively illustrated. For convenience and clarity of description, the well tool 24 is described below as it may be used in the FIG. 1 system 10 and method, however, it should be clearly understood that the well tool may be used in other systems and methods, in keeping with the principles of this disclosure.

In FIGS. 2A-D, successive longitudinal sections of the well tool 24 are depicted. In FIG. 2E, a lateral cross-section is depicted, taken along line 2E-2E of FIG. 2C. In FIG. 2F, a longitudinal cross-section is depicted, taken along line 2F-2F of FIG. 2E. Accordingly, the longitudinal cross-section depicted in FIG. 2F is orthogonal to the longitudinal cross-section depicted in FIG. 2C.

The well tool 24 is in a run-in configuration as illustrated in FIGS. 2A-F. In this configuration, the well tool 24 can be conveyed to a desired location in the wellbore 12, and then set using the setting tool 22, for example. If necessary, the well tool 24 can be displaced through the restriction 18 prior to being set. In addition, the well tool 24 is capable of being retrieved through the restriction 18 after having been set in the wellbore 12.

Note that the setting tool 22 is not depicted in FIGS. 2A-F. The setting tool 22 may be any type of mechanically, electrically, hydraulically or otherwise actuated setting tool capable of applying a longitudinally directed force to an outer setting sleeve 32 of the well tool 24, and an oppositely directed force to a connector 34 of the well tool, to thereby produce relative longitudinal displacement between the setting sleeve and the connector. The longitudinal force applied to the setting sleeve 32 is in a downward direction as viewed in FIGS. 2A-D, and the force applied to the connector 34 is in an upward direction as viewed in FIGS. 2A-D. Such setting tools are well known to those skilled in the art, and so the setting tool 22 is not described further herein.

As viewed in FIGS. 2A-F, the connector 34 is connected at an upper end of an inner mandrel assembly 36 that extends longitudinally through most of the well tool 24. A significant portion of the mandrel assembly 36 is tubular, so that a flow passage 38 is provided through the mandrel assembly between upper ports 40 and lower ports 42 formed through a wall of the mandrel assembly. Note, however, that flow through the upper ports 40 is blocked by a valve sleeve 44 in the FIGS. 2A-F run-in configuration. The valve sleeve 44 is releasably secured in this flow blocking position relative to the inner mandrel assembly 36 by release members 46 (such as, shear pins, shear screws, a snap ring, etc.).

The setting sleeve 32 comprises an uppermost portion of an outer housing assembly 48 of the well tool 24. A body lock ring 50 is initially inwardly retained in engagement with an outer surface of the inner mandrel assembly 36 by a retainer sleeve 52, so that the body lock ring permits upward displacement of the inner mandrel assembly 36 relative to the outer housing assembly 48, but prevents downward displacement of the inner mandrel assembly relative to the outer housing assembly.

A similar body lock ring 54 is contained in a collar 56 secured to the outer housing assembly 48. However, the body lock ring 54 does not engage the inner mandrel assembly 36 in the run-in configuration.

An upper section 48*a* of the outer housing assembly 48 is initially releasably secured against upward longitudinal displacement relative to a lower section 48*b* of the outer housing assembly by release members 60 (such as, shear pins, shear screws, a snap ring, etc.). A downwardly directed force can be applied by the setting tool 22 to the outer housing assembly 48 (and transmitted from the upper section 48*a* to the lower section 48*b*) to set the well tool 24, but the release members 60 ensure that only a predetermined upwardly directed force can be applied to the upper section 48*a*, prior to permitting limited upward displacement of the upper section 48*a* relative to the lower section 48*b* during retrieval of the well tool 24, as described more fully below. A stop ring 62 (such as, a C-ring or snap ring, etc.) permits only limited upward displacement of the upper section 48*a* relative to the lower section 48*b*, after the release members 60 are sheared or otherwise released.

In the FIGS. 2A-F example, the well tool 24 includes two annular seals 28, an upper annular seal 28*a* and a lower annular seal 28*b*. The upper and lower annular seals 28*a,b* are configured the same in this example, although they face in opposite longitudinal directions. In other examples, only a single annular seal may be used, or other numbers of annular seals may be used.

Figure 2A:
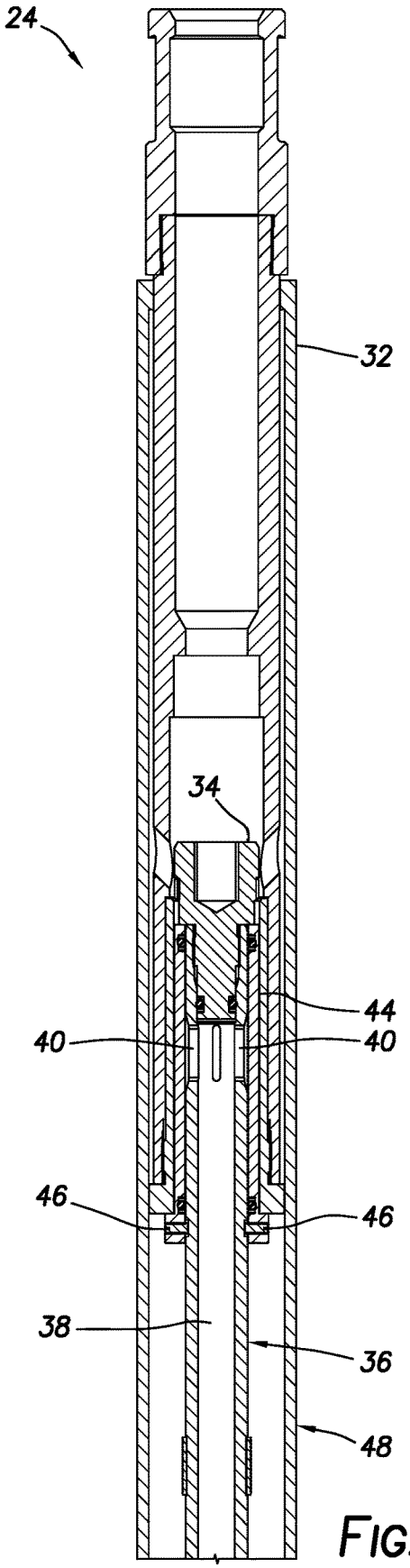
FIGS. 2A-F are representative cross-sectional views of an example of a well tool embodying the principles of this disclosure, and which may be used in the system and method of FIG. 1, the well tool being depicted in a run-in configuration.
Figure 2B:
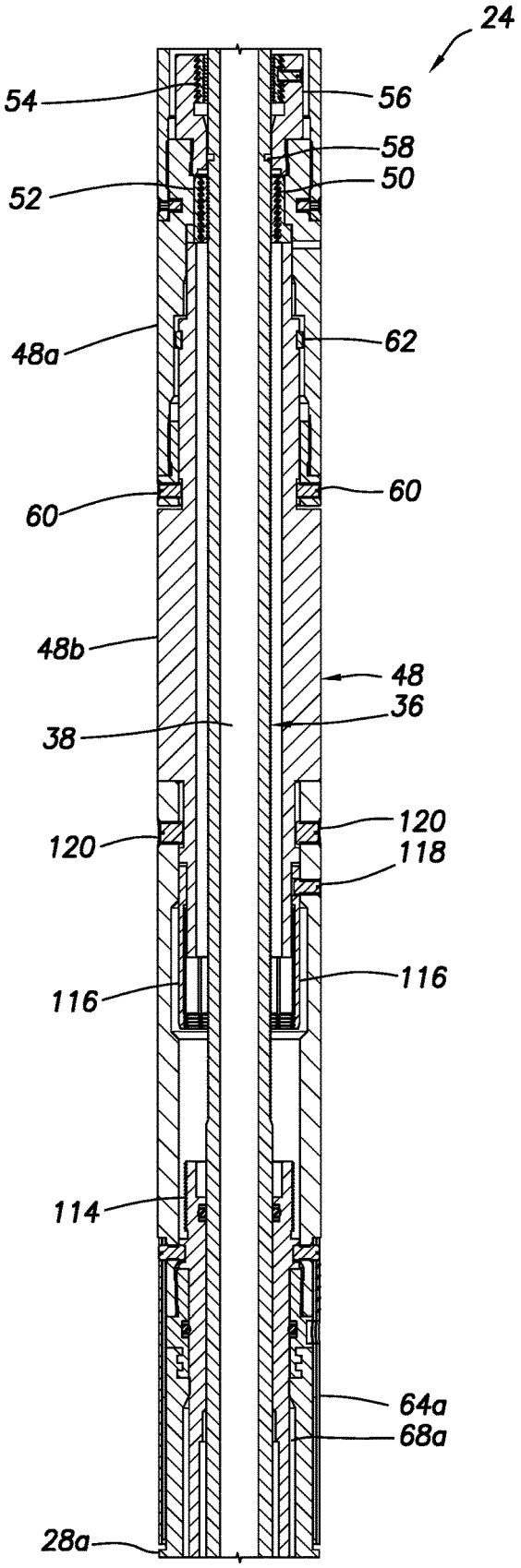

As may be seen in FIG. 2B, the lower section 48*b* of the outer housing assembly 48 is connected to an upper end of the upper annular seal 28*a*. An upper anti-extrusion back-up or barrier 64*a* is also connected to the lower section 48*a* and outwardly overlies most of the upper annular seal 28*a*. A lower anti-extrusion barrier 64*b* outwardly overlies most of the lower annular seal 28*b*. The upper and lower anti-extrusion barriers 64*a,b* are configured the same in this example, although they face in opposite longitudinal directions.

The upper and lower annular seals 28*a,b* in this example are in the form of deformable sleeves. The deformable sleeves may be made of a resilient material (such as, an elastomer) capable of sealingly engaging the inner surface of the wellbore 12. In other examples, the deformable sleeves could be made of a substantially non-resilient material (such as, a plastic, metal or composite material). The scope of this disclosure is not limited to use of any particular material or configuration for the upper or lower annular seals 28*a,b*.

The upper and lower anti-extrusion barriers 64*a,b* in this example are in the form of deformable sleeves that have a substantially increased rigidity and/or strength as compared to the annular seals 28*a,b*. The anti-extrusion barriers 64*a,b* serve to prevent extrusion of the annular seals 28*a,b* when the annular seals sealingly engage the inner surface of the wellbore 12 and a pressure differential is experienced across the annular seals in the annulus 31 (see FIG. 1).

Thus, in this example, the anti-extrusion barriers 64*a,b* are outwardly extendable with the respective annular seals 28*a,b*, but are significantly more resistant to extrusion than are the annular seals. For example, the anti-extrusion barriers 64*a,b* may be made of a relatively high-strength material (such as, KEVLAR™, a metal or composite material). However, use of the anti-extrusion barriers 64*a,b* is not necessary, since the annular seals 28*a,b* may be sufficiently extrusion resistant in some cases to resist extrusion due to an expected pressure differential in the annulus 31.

Figure 8:
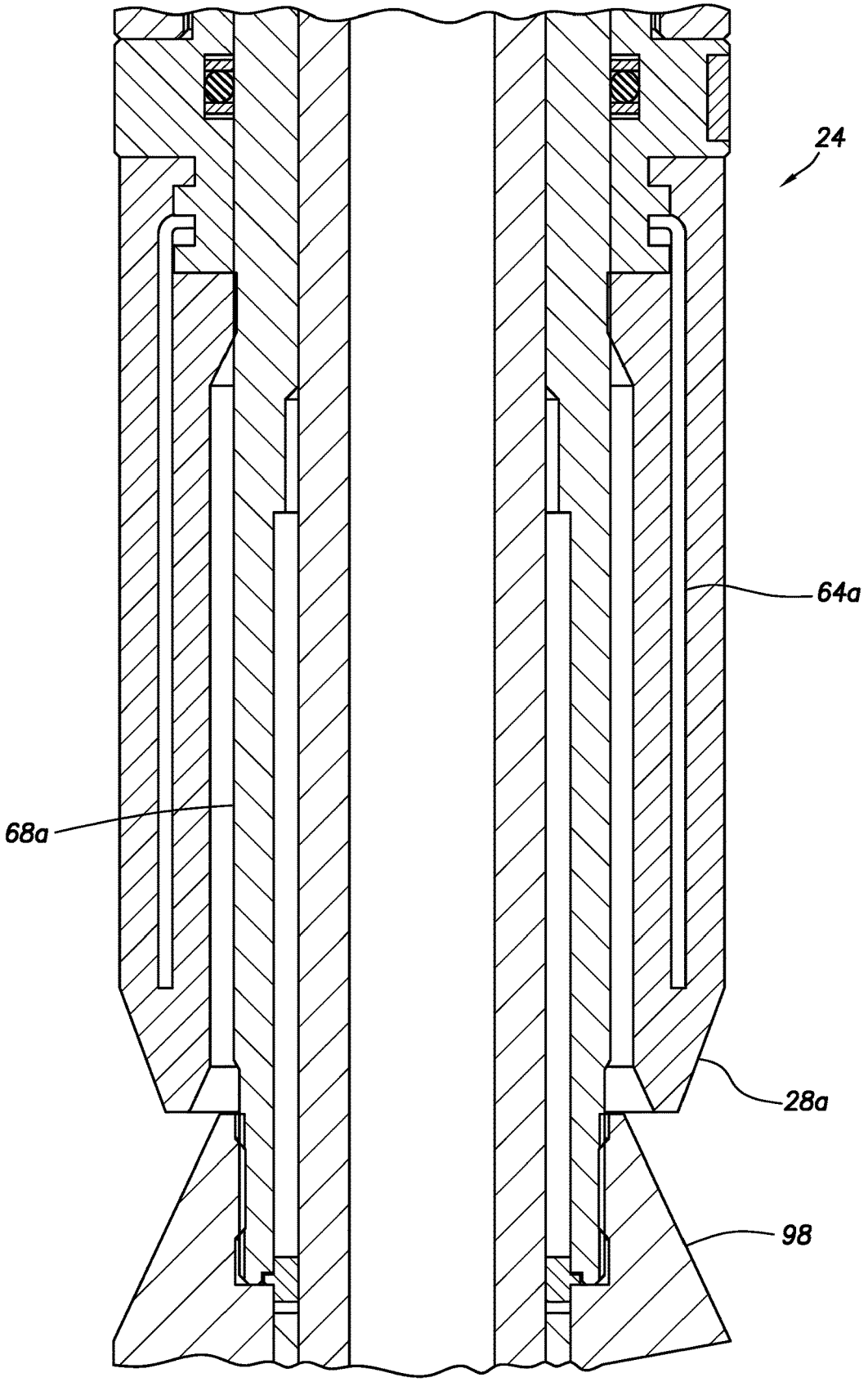
FIG. 8 is a representative cross-sectional view of a portion of the well tool with an example of an annular seal having a reinforcement therein.

In some examples, the anti-extrusion barriers 64*a,b* could be integrated with the annular seals 28*a,b* as "reinforcements" in the seals. One example of this is representatively illustrated in FIG. 8 for the upper annular seal 28*a*.

Figure 2C:
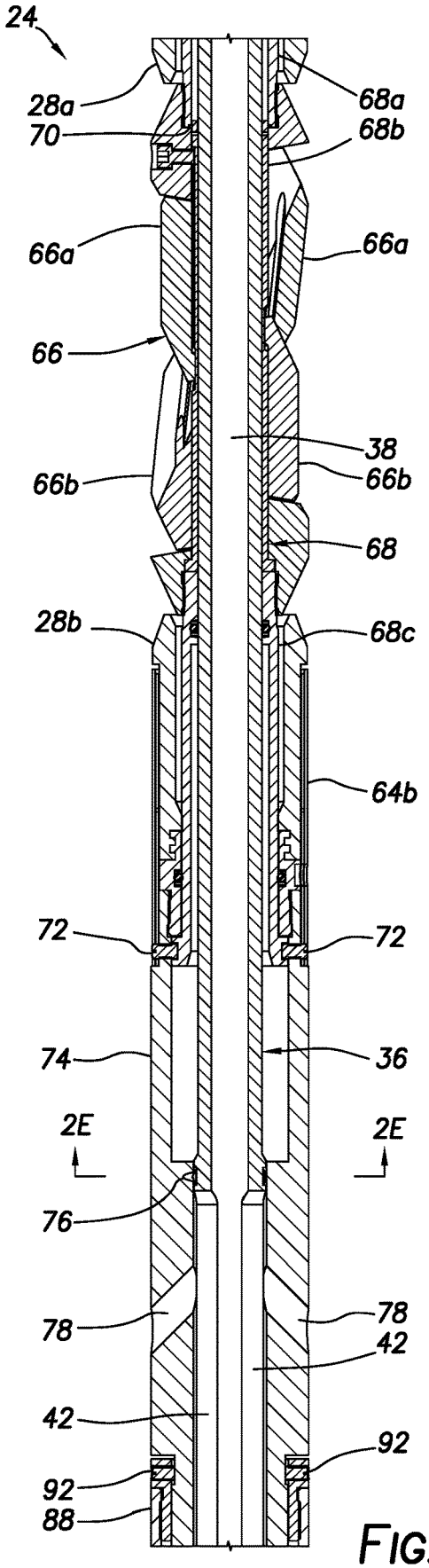
Figure 2D:
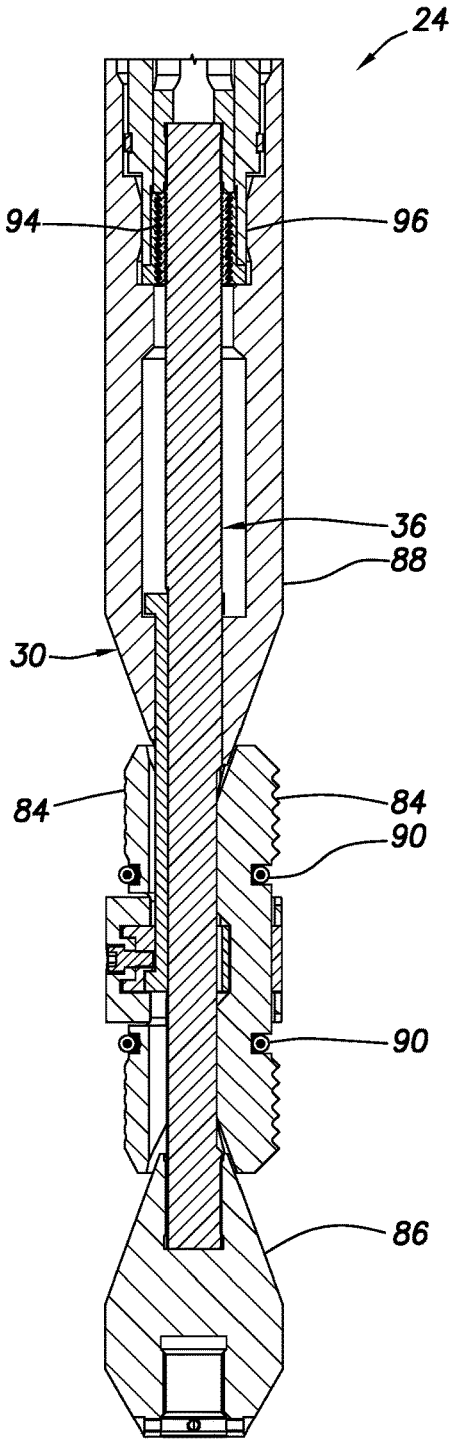
Figure 2E:
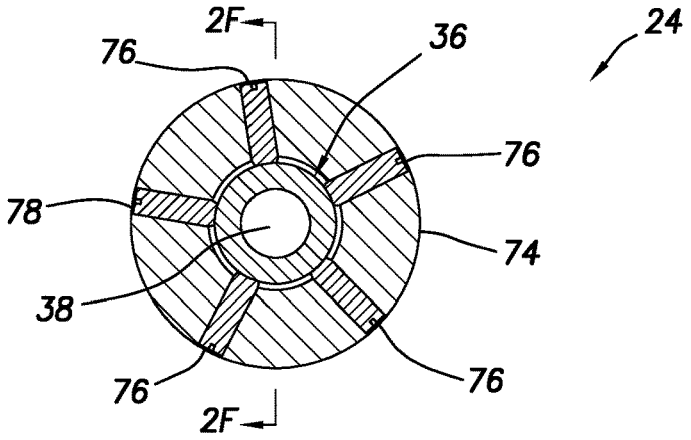
Figure 2F:
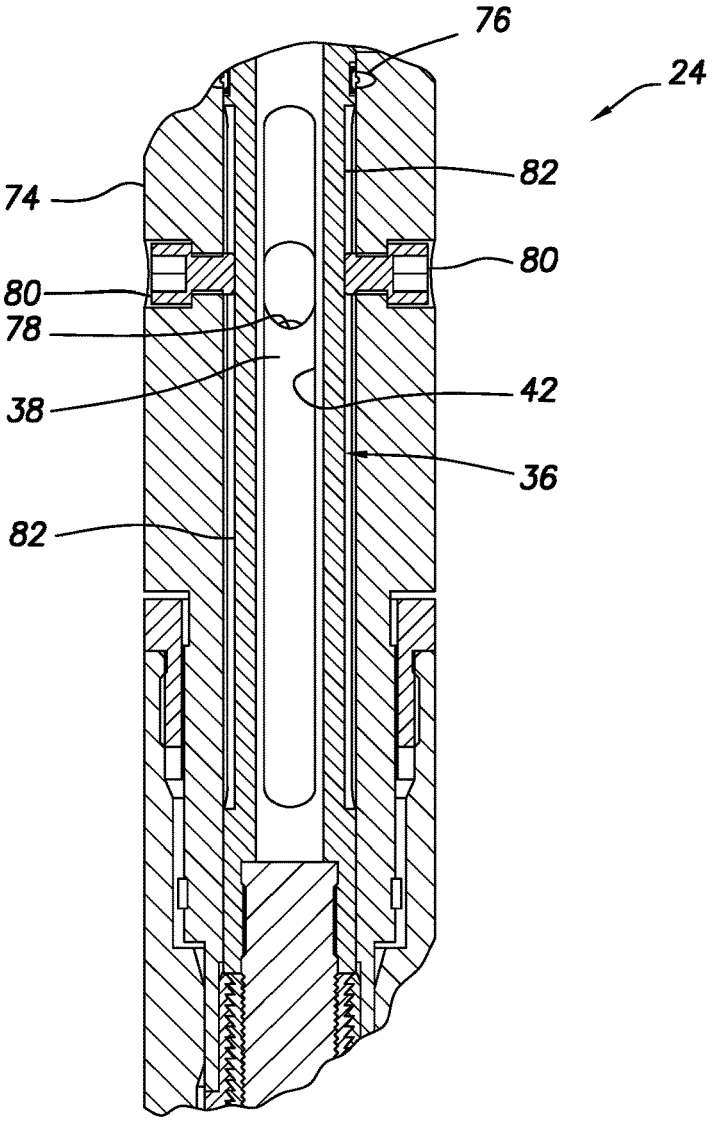

As depicted in FIG. 2C, a radial expansion mechanism 66 is positioned on the inner mandrel assembly 36 between the upper and lower annular seals 28*a,b*. The radial expansion mechanism 66 serves to radially outwardly extend the annular seals 28*a,b* downhole when the well tool 24 is set. For this purpose, the radial expansion mechanism 66 includes an upper set of circumferentially distributed segments 66*a* cooperatively engaged with a lower set of circumferentially distributed segments 66*b*.

In the FIGS. 2A-F run-in configuration, the radial expansion mechanism 66 is radially retracted and the annular seals 28*a,b* are longitudinally spaced apart from the segments 66*a,b* so that the annular seals and the segments can pass through the restriction 18, in this example. When the well tool 24 is set, the annular seals 28*a,b* are longitudinally displaced relative to the radial expansion mechanism 66, so that the annular seals then radially overlie and encircle the segments 66*a,b*, and the radial expansion mechanism can then radially outwardly extend the annular seals into sealing engagement with the inner surface of the wellbore 12, as described more fully below.

Longitudinal compression of the segments 66*a,b* is initially prevented by an inner sleeve assembly 68 including an upper sleeve 68*a*, a middle sleeve 68*b* and a lower sleeve 68*c*. The sleeves 68*a-c* abut each other, a release member 70 (such as, a shear ring) initially prevents upward displacement of the middle sleeve 68*b* relative to the upper sleeve 68*a*, and release members 72 (such as, shear pins, shear screws, a snap ring, etc.) initially prevent downward displacement of the lower sleeve 68*c* relative to an outer housing 74.

The outer housing 74 is initially releasably secured against longitudinal displacement relative to the inner mandrel assembly 36 by release members 76 (which are more clearly visible in FIG. 2E). The lower ports 42 in the inner mandrel assembly 36 are rotationally aligned with ports 78 in the outer housing 74. This alignment is maintained by bolts or lugs 80 (which are more clearly visible in FIG. 2F) extending through the outer housing 74 and into slots 82 formed on the inner mandrel assembly 36.

The anchor mechanism 30 includes a set of multiple slips 84 positioned longitudinally between a lower conical wedge 86 connected at a lower end of the inner mandrel assembly 36, and an upper wedge 88 connected to the outer housing 74. In the run-in configuration of FIGS. 2A-F, the slips 84 are inwardly retracted, so that they can pass through the restriction 18 (see FIG. 1).

Extension springs 90 radially inwardly bias the slips 84 toward the inner mandrel assembly 36. When the well tool 24 is set, as described more fully below, a longitudinal distance between the lower and upper wedges 86, 88 will decrease, thereby outwardly extending the slips 84 into gripping engagement with the inner surface of the wellbore 12.

Release members 92 (such as, shear pins, shear screws, a snap ring, etc.) initially prevent upward longitudinal displacement of the outer housing 74 relative to the upper wedge 88. A body lock ring 94 is initially retained in engagement with an outer surface of the inner mandrel assembly 36 by a lower retainer sleeve extension 96 of the outer housing 74. The body lock ring 94 prevents upward displacement of the outer housing 74 and upper wedge 88 relative to the inner mandrel assembly 36 when the well tool 24 is set, as described more fully below.

Referring additionally now to FIGS. 3A-D, the well tool 24 is representatively illustrated in a set configuration. The annular seals 28*a,b* have been extended radially outward, so that they can sealingly contact the inner surface of the wellbore 12 (see FIG. 1). The slips 84 have been extended outward, so that they can grippingly engage the inner surface of the wellbore 12.

To achieve this set configuration of the well tool 24 from the run-in configuration depicted in FIGS. 2A-F, a downwardly directed (as viewed in FIGS. 3A-D) force is applied by the setting tool 22 to the setting sleeve 32 while an upwardly directed (as viewed in FIGS. 3A-D) force is applied by the setting tool to the connector 34. When sufficient force has been applied, the inner mandrel assembly 36 displaces upward relative to the outer housing assembly 48.

At this point, the release members 76 prevent relative longitudinal displacement between the inner mandrel assembly 36 and the outer housing 74, and so the outer housing 74 displaces upward with the inner mandrel assembly relative to the outer housing assembly 48 (which is biased downward by the force exerted by the setting tool 22 on the setting sleeve 32). This results in a decrease in the longitudinal separation between the outer housing 74 and the outer housing assembly 48.

The upper annular seal 28*a* and upper anti-extrusion barrier 64*a* are radially outwardly deformed by passing downwardly over an upper expansion cone 98 secured to the upper inner sleeve 68*a*. In this manner, the upper annular seal 28*a* and the upper anti-extrusion barrier 64*a* are expanded radially over the radial expansion mechanism 66, so that they outwardly overlie and encircle an upper portion of the radial expansion mechanism.

When a further sufficient force has been applied, the release members 72 shear or otherwise release, thereby permitting the outer housing 74 to displace upwardly relative to the outer housing assembly 48, and further decreasing the longitudinal separation between the outer housing 74 and the outer housing assembly 48. The lower annular seal 28*b* and lower anti-extrusion barrier 64*b* are radially outwardly deformed by passing upwardly over a lower expansion cone 100 connected to the lower inner sleeve 68*c*. In this manner, the lower annular seal 28*b* and the lower anti-extrusion barrier 64*b* are expanded radially over the radial expansion mechanism 66, so that they outwardly overlie and encircle a lower portion of the radial expansion mechanism.

When a further sufficient force has been applied, the release members 76 shear or otherwise release, thereby permitting the inner mandrel assembly 36 and the lower wedge 86 to displace upward relative to the outer housing 74 and the upper wedge 88. In this manner, the longitudinal separation between the upper and lower wedges 88, 86 decreases, thereby forcing the slips 84 to displace outward. In this manner, the slips 84 are displaced into gripping engagement with the inner surface of the wellbore 12 (see FIG. 1). The body lock ring 94 prevents the inner mandrel assembly 36 from displacing downward relative to the upper wedge 88, thereby maintaining the gripping engagement between the slips 84 and the inner surface of the wellbore 12.

When a further sufficient force has been applied, the release member 70 shears or otherwise releases, thereby permitting an upper end of the middle inner sleeve 68*b* to telescope into a lower end of the upper inner sleeve 68*a*. This also allows the radial expansion mechanism 66 to longitudinally compress and thereby radially outwardly expand the upper and lower annular seals 28*a,b* into sealing engagement with the inner surface of the wellbore 12 (see FIG. 1). The upper and lower anti-extrusion barriers 64*a,b* are also outwardly expanded by the longitudinal compression of the radial expansion mechanism 66, so that the anti-extrusion barriers can prevent extrusion of the annular seals due to a pressure differential across them in the annulus 31 (see FIG. 1).

Note that an externally ridged or toothed surface 114 at an upper end of the upper inner sleeve 68*a* engages a series of internally ridged or toothed flexible collets 116 in the lower section 48*b* of the outer housing assembly 48 in the set configuration. As described more fully below, this engagement between the surface 114 and the collets 116 ensures that the upper inner sleeve 68*a* will displace upward with the lower section 48*b* of the outer housing assembly 48 in initial stages of unsetting the well tool 24. Initially, the collets 116 are releasably secured against displacement relative to the outer housing assembly 48 by release members 118 (such as, shear screws, shear pins, a shear or snap ring, etc.).

Figure 4A:
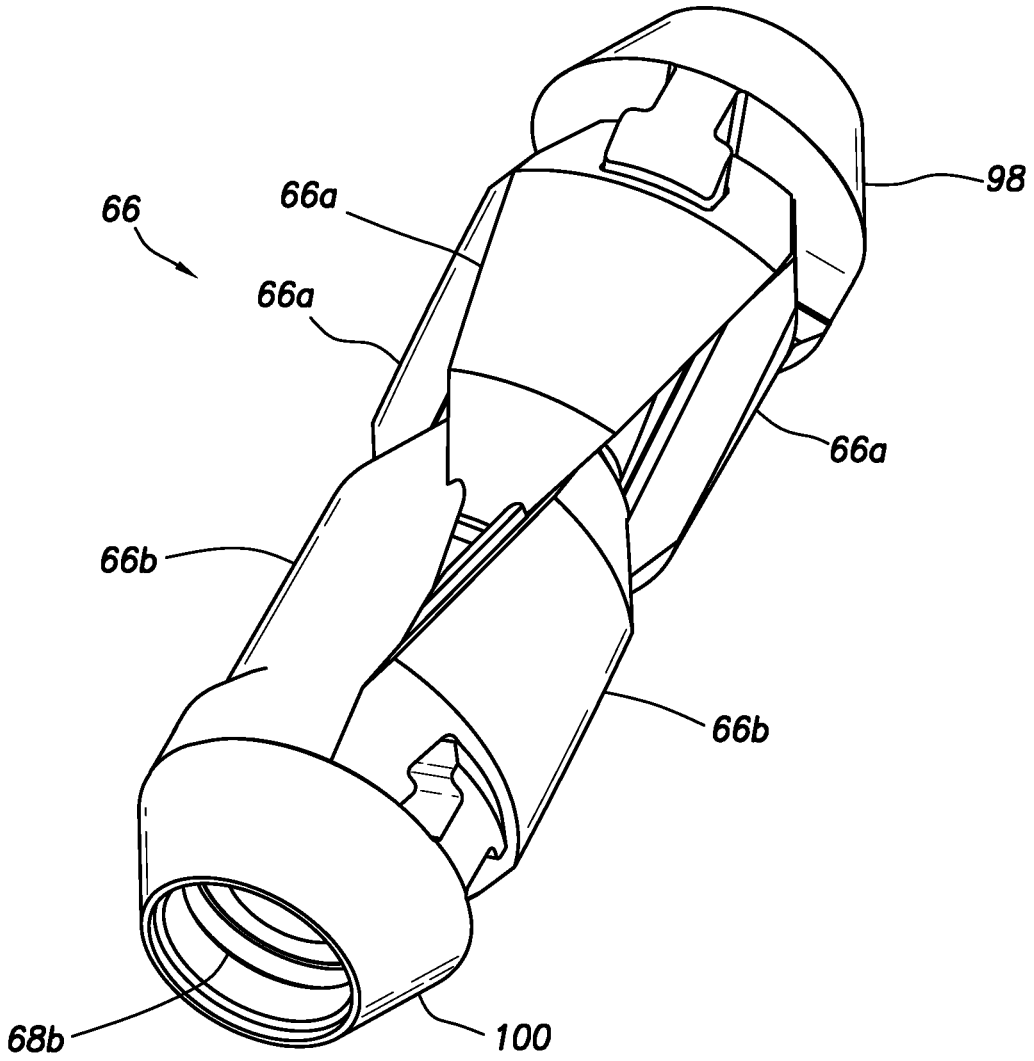
FIGS. 4A & B are representative perspective views of an example of a radial expansion device in respective radially retracted and radially expanded configurations.

Referring additionally now to FIGS. 4A & B, an example of the radial expansion mechanism 66 is representatively illustrated in respective radially retracted and radially expanded configurations. Note that, in the radially retracted configuration, the radial expansion mechanism 66 is longitudinally extended, and in the radially expanded configuration, the radial expansion mechanism is longitudinally compressed.

The FIG. 4A radially retracted configuration of the radial expansion mechanism 66 corresponds to the run-in configuration of the well tool 24 (e.g., as depicted in FIGS. 2A-F). The FIG. 4B radially expanded configuration of the radial expansion mechanism 66 corresponds to the set configuration of the well tool 24 (e.g., as depicted in FIGS. 3A-D).

Figure 4B:
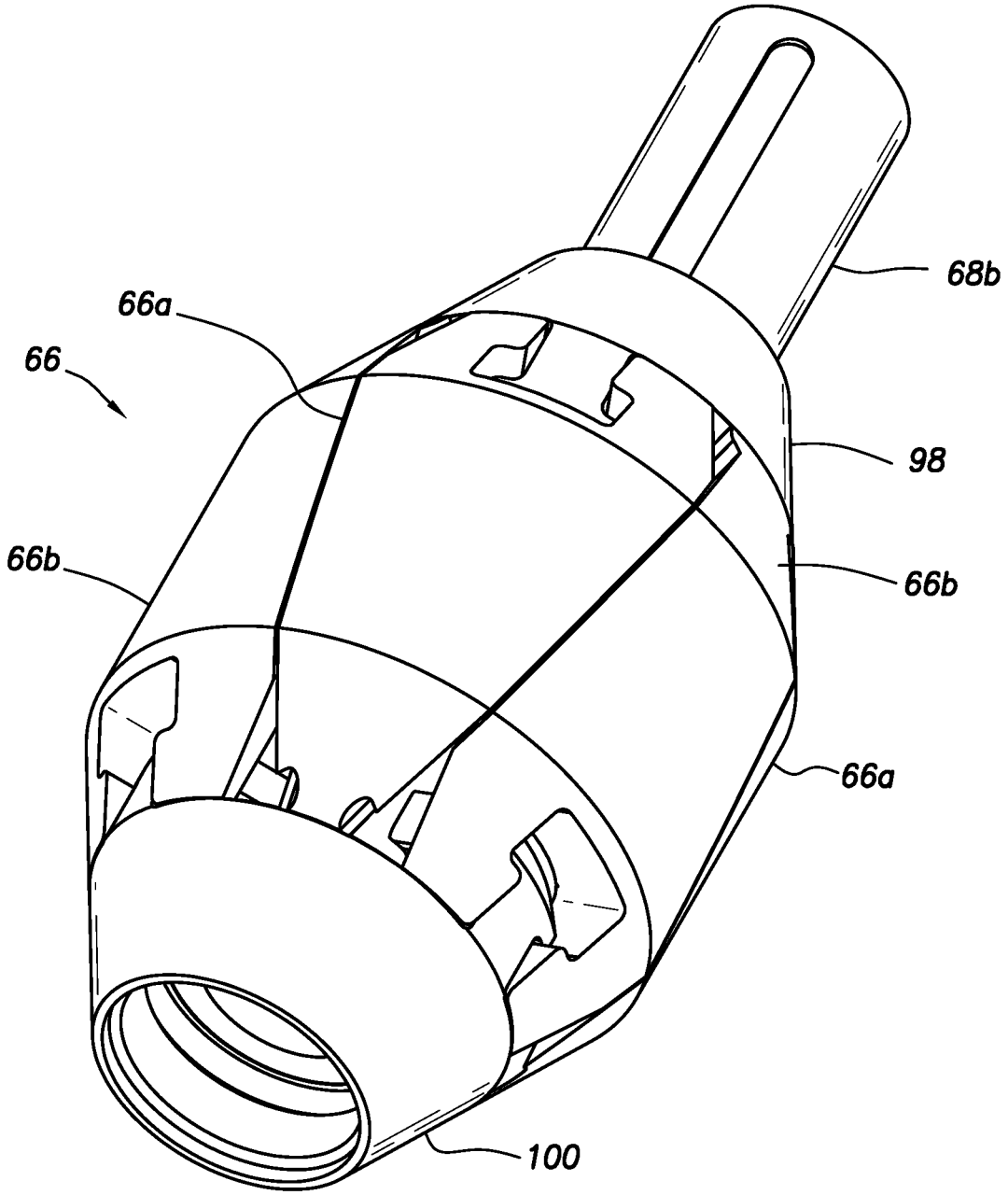

As the segments 66*a,b* are displaced longitudinally toward each other from the FIG. 4A configuration to the FIG. 4B configuration, the segments are cooperatively engaged, so that they deflect each other in a radially outward direction. Conversely, if the segments 66*a,b* are displaced longitudinally away from each other from the FIG. 4B configuration to the FIG. 4A configuration, as described more fully below for unsetting of the well tool 24, the segments are also cooperatively engaged, so that they deflect each other in a radially inward direction.

Figure 5:
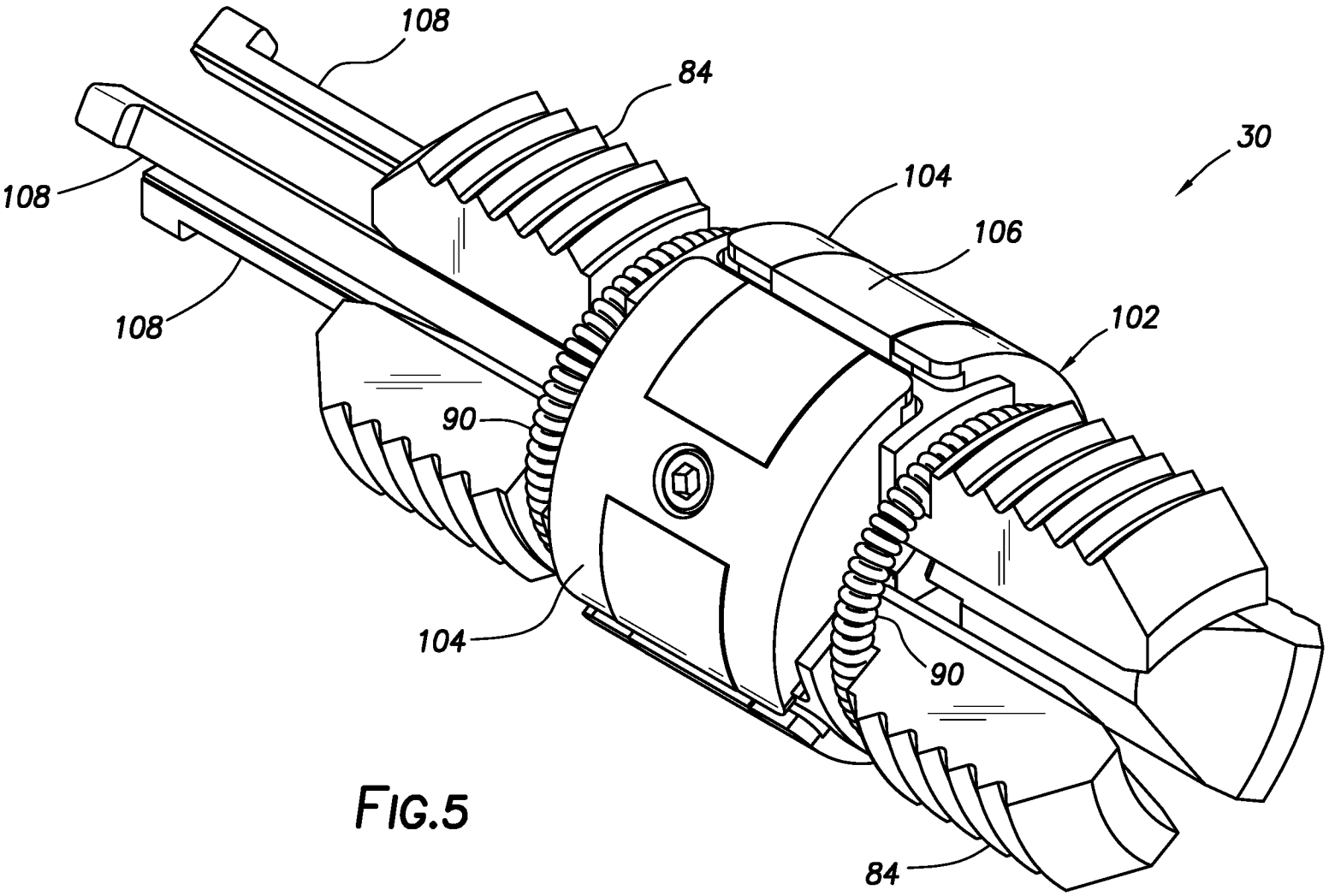
FIG. 5 is a representative perspective view of an example of a slip assembly that may be used with the well tool.
Figure 6A:
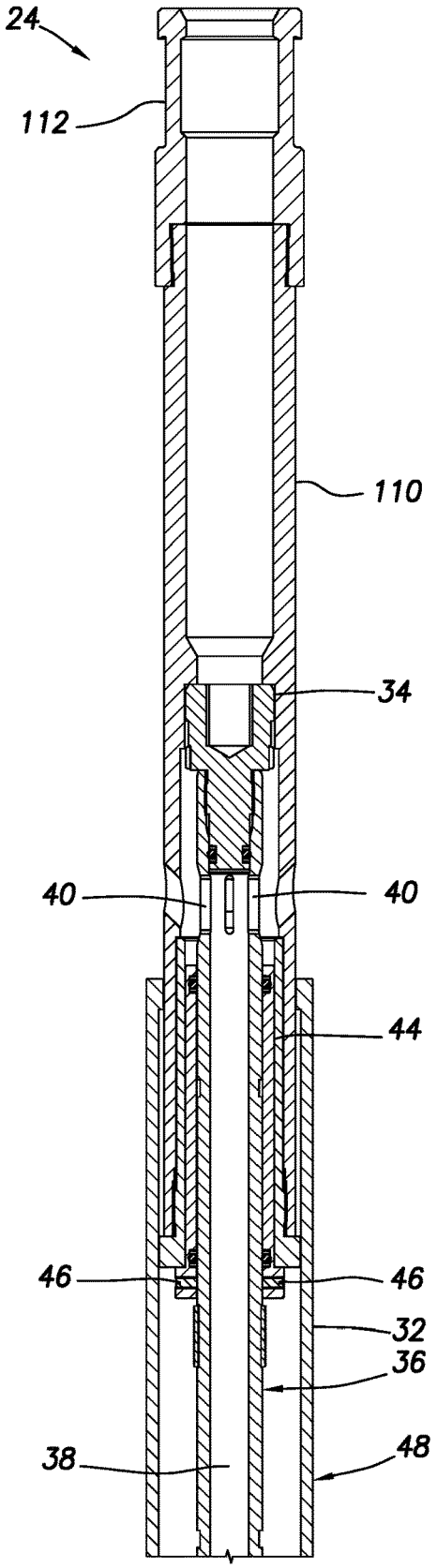
FIGS. 6A-D are representative cross-sectional views of the well tool in a communicated configuration.
Figure 6B:
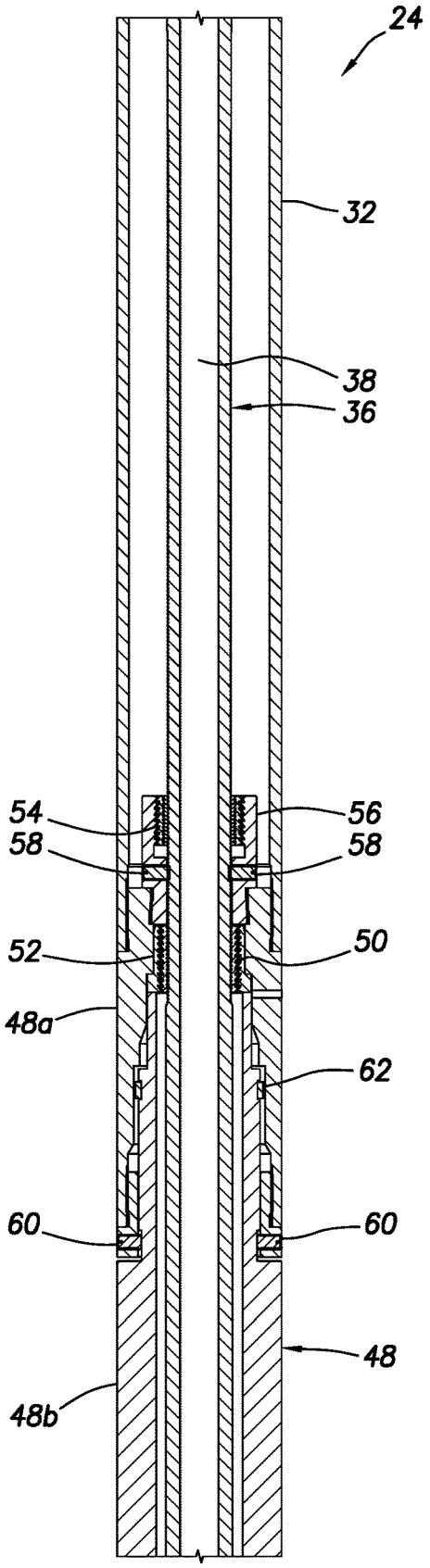
Figure 6C:
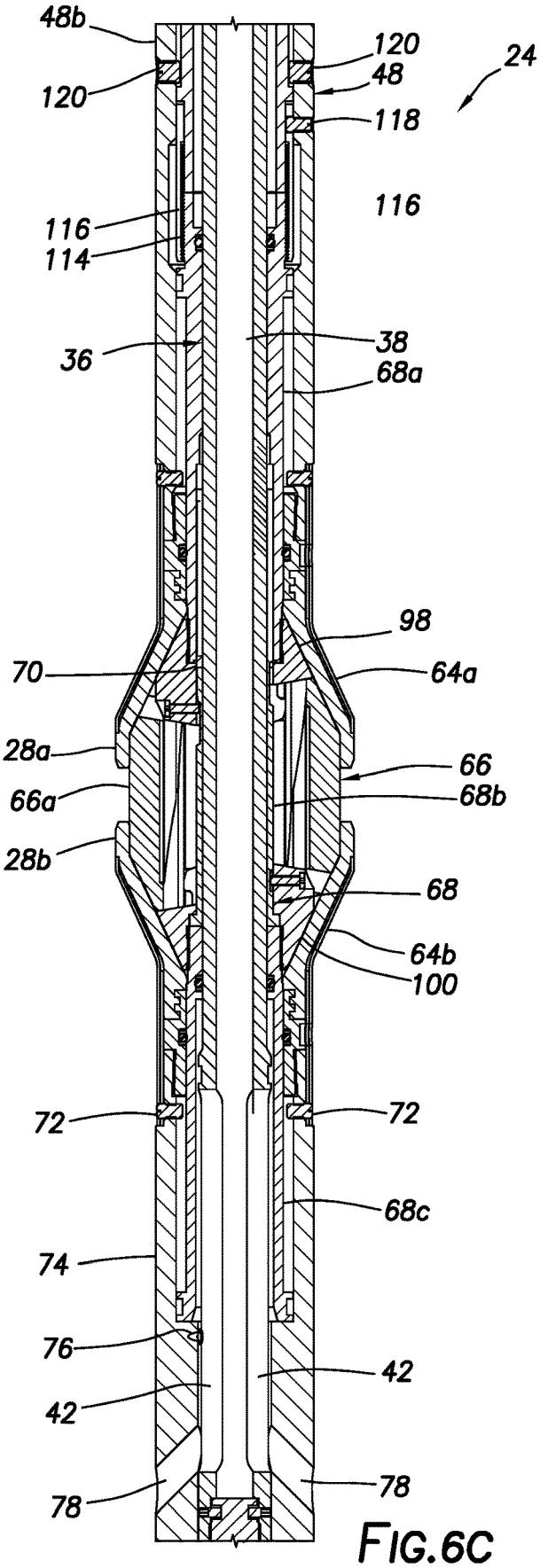
Figure 6D:
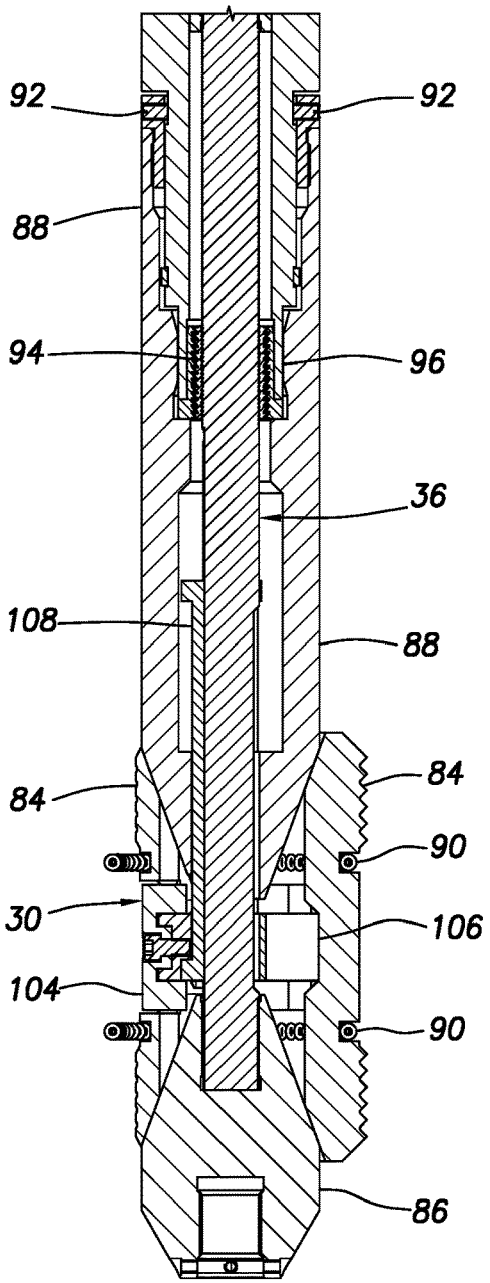

Referring additionally now to FIG. 5, an example of a slip assembly 102 of the anchor mechanism 30 is representatively illustrated. The slip assembly 102 in this example includes the slips 84 and the springs 90 described above. In addition, the slip assembly 102 includes spacers 104 for maintaining appropriate circumferential spacing between the slips 84, and a retainer 106 for retaining the slip assembly 102 in its configuration about the inner mandrel assembly 36 (see FIG. 3E).

Figure 3A:
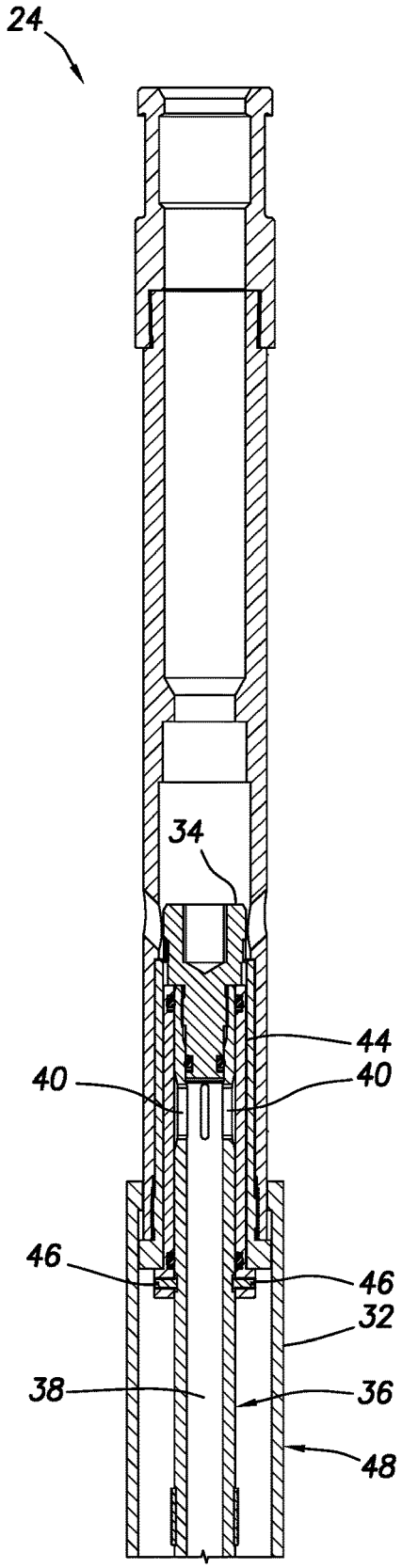
FIGS. 3A-D are representative cross-sectional views of the well tool in a set configuration.
Figure 3B:
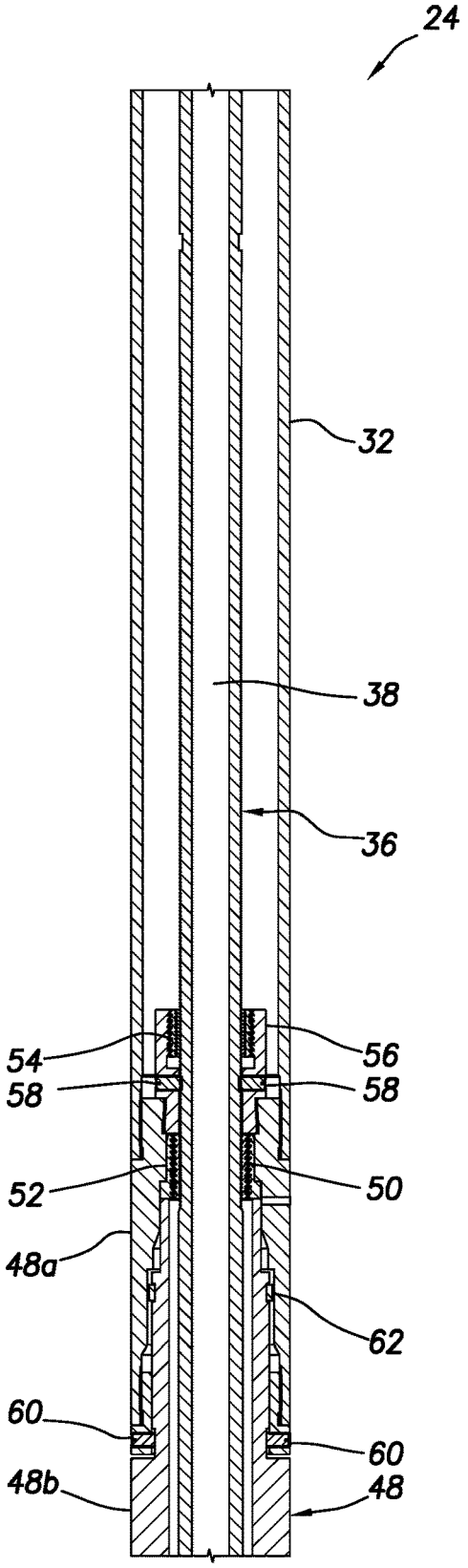
Figure 3C:
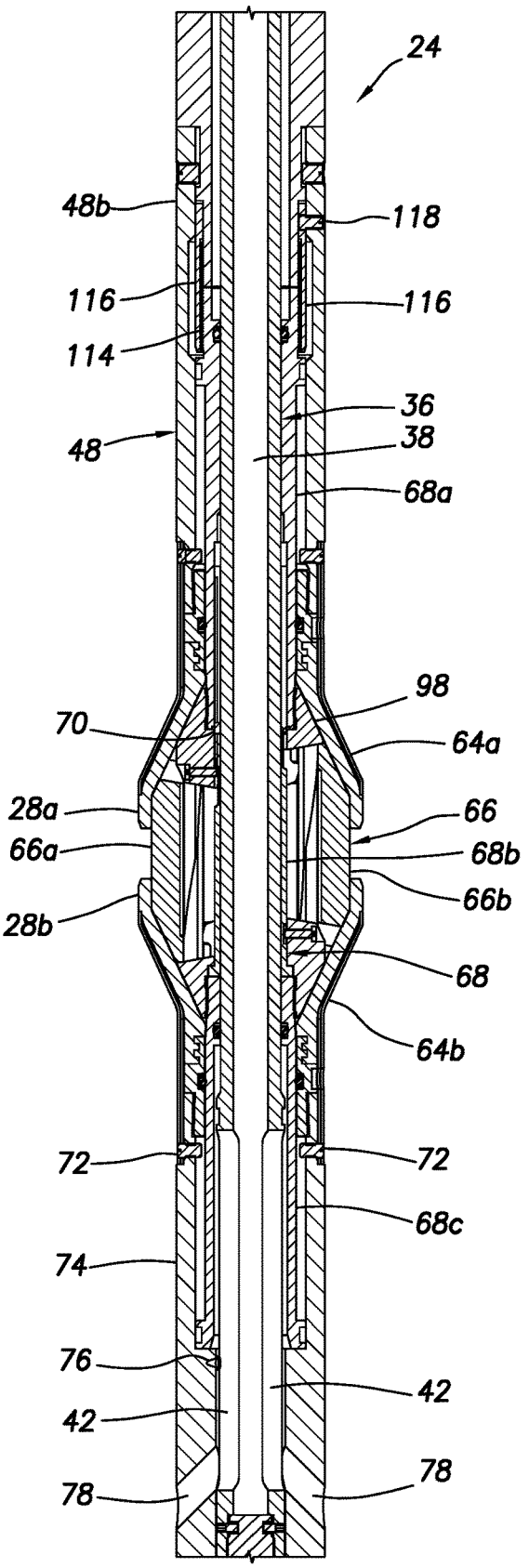
Figure 3D:
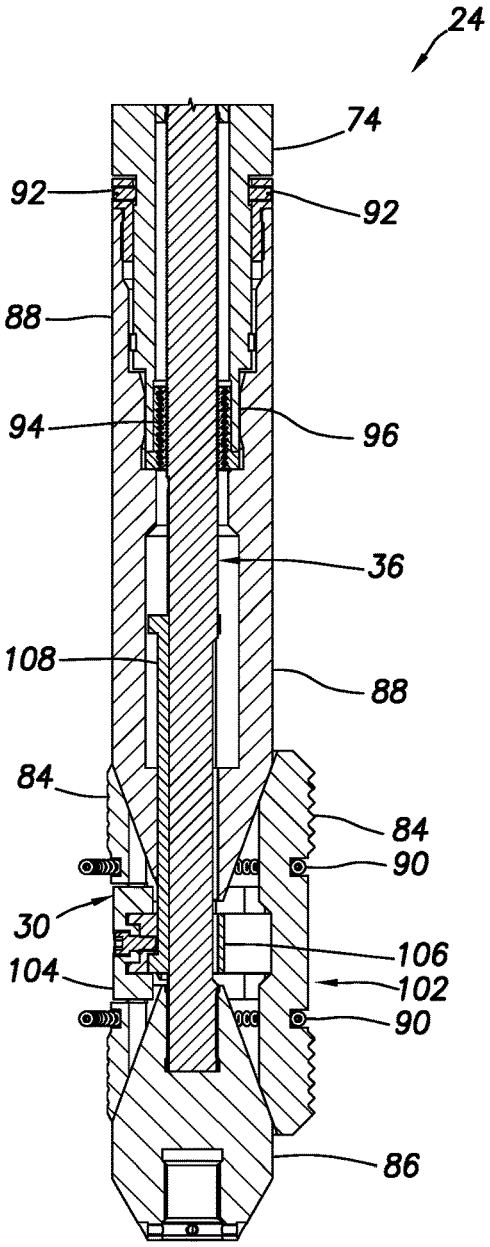
Figure 7A:
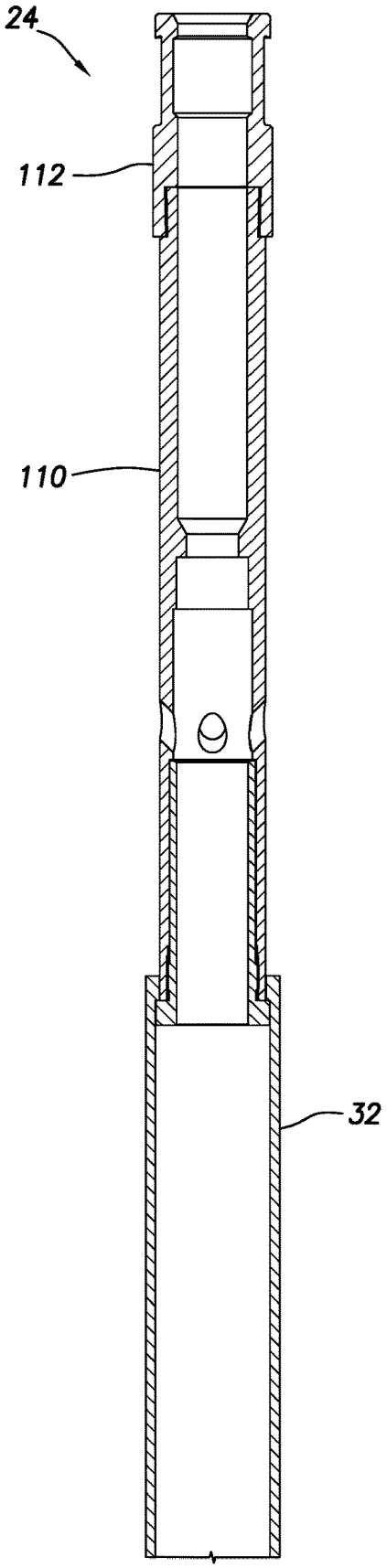
FIGS. 7A-D are representative cross-sectional views of the well tool in an unset retrieval configuration.
Figure 7B:
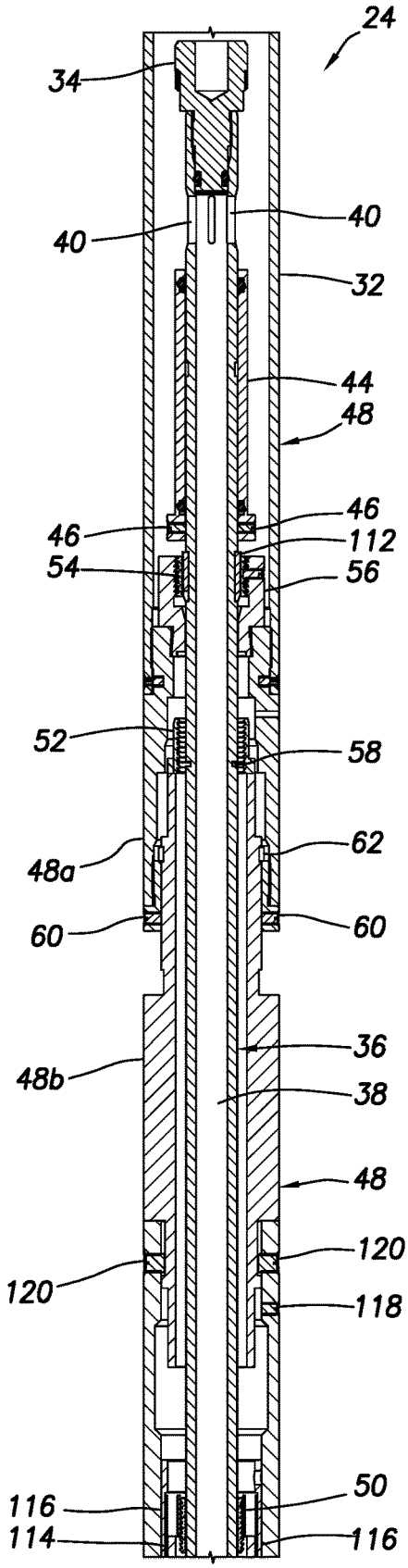
Figure 7C:
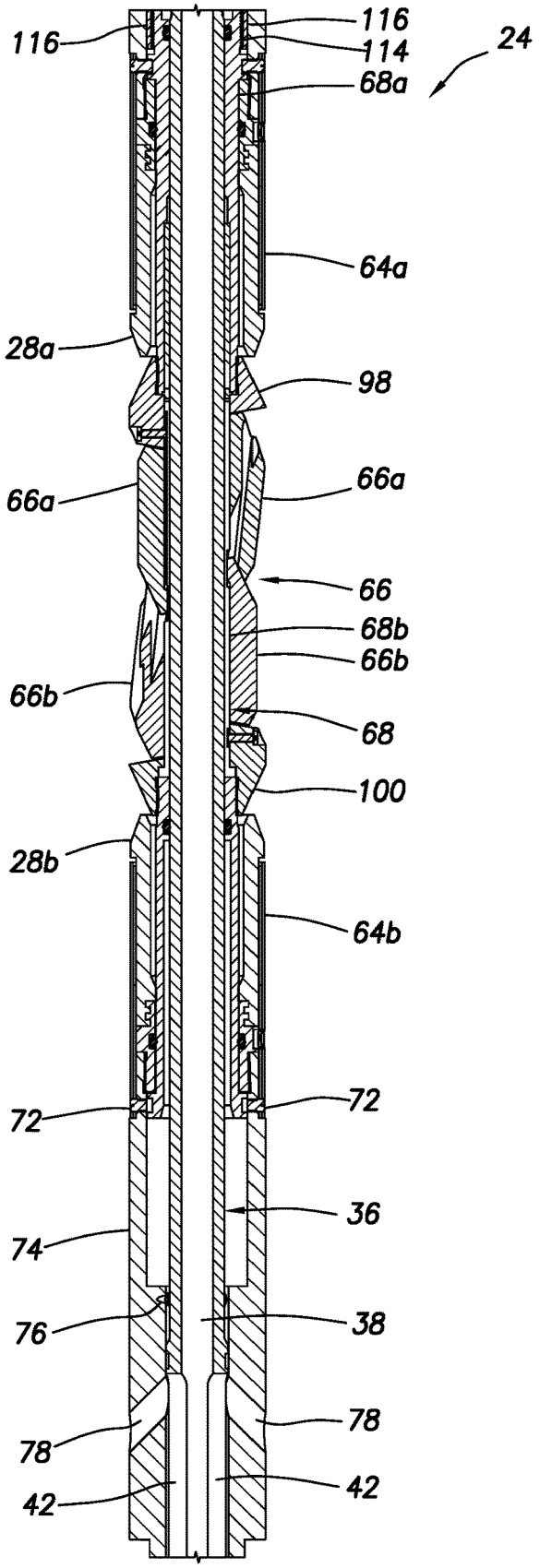
Figure 7D:
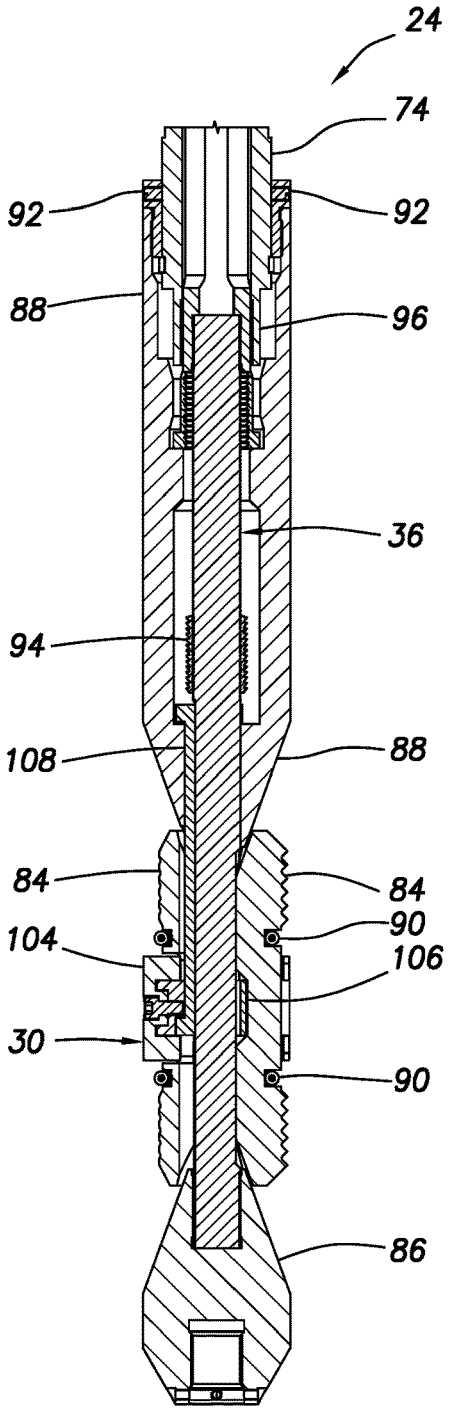

In addition, lower ends of longitudinally extending positioning rods or bars 108 extend into the retainer 106, and upper ends of the positioning bars extend into a recess in the upper wedge 88 (see FIG. 3D). The positioning bars 108 maintain the slips 84 approximately "centered" between the lower and upper wedges 86, 88 as the well tool 24 is being conveyed into the wellbore 12 (see FIG. 2D), and as the well tool is being retrieved from the wellbore (see FIG. 7D).

Referring additionally now to FIGS. 6A-D, the well tool 24 is representatively illustrated in a communicated configuration, prior to retrieval of the well tool. If the well tool 24 is not to be retrieved, the communicated configuration of FIGS. 6A-D may not be used.

The communicated configuration provides for equalizing pressure across the well tool 24 prior to retrieving the well tool. To achieve this communicated configuration, a downwardly directed force is applied to a retrieval sleeve 110. In this example, the retrieval sleeve 110 has a tubular fishing neck 112 connected at an upper end thereof for convenient engagement by an appropriate fishing/jarring tool or other type of retrieval tool well known to those skilled in the art.

When a sufficient downwardly directed force is applied to the retrieval sleeve 110, the release members 46 shear or otherwise release, thereby permitting the valve sleeve 44 to displace downward with the retrieval sleeve relative to the inner mandrel assembly 36. The inner mandrel assembly 36 is still prevented from displacing downwardly by the body lock ring 94, and the slips 84 remain grippingly engaged with the inner surface of the wellbore 12, when the downwardly directed force is applied to the retrieval sleeve 110.

In this manner, the upper ports 40 in the inner mandrel assembly 36 are unblocked and fluid flow is permitted between the annulus 31 (see FIG. 1) above the annular seals 28*a,b* and the annulus below the annular seals via the flow passage 38. This allows any pressure differential across the well tool 24 to be relieved prior to unsetting the well tool and retrieving it from the wellbore 12.

Referring additionally now to FIGS. 7A-D, the well tool 24 is representatively illustrated in an unset retrieval configuration, in which the well tool may be retrieved from the wellbore 12. Note that the annular seals 28*a,b* and the anti-extrusion barriers 64*a,b* are radially inwardly retracted out of engagement with the wellbore 12, and the slips 84 are inwardly retracted out of engagement with the wellbore. The well tool 24 can now be displaced uphole and through the restriction 18 (see FIG. 1), if necessary.

To achieve the FIGS. 7A-D unset retrieval configuration of the well tool 24, a sufficient upwardly directed force is applied to the retrieval sleeve 110. This upwardly directed force may be applied by the same fishing/jarring tool engaged with the fishing neck 112 as was previously used to apply the downwardly directed force to the retrieval sleeve to achieve the communicated configuration of FIGS. 6A-D.

When the sufficient upwardly directed force is applied to the retrieval sleeve 110, the release members 60 shear or otherwise release, thereby permitting the upper section 48*a* of the outer housing assembly 48 to displace upward relative to the lower section 48*b*. This longitudinally separates the retainer 52 from the body lock ring 50, thereby permitting the outer housing assembly 48 to displace upward relative to the inner mandrel assembly 36.

As the outer housing assembly 48 displaces upward relative to the inner mandrel assembly 36, the body lock ring 54 eventually engages a radially enlarged collar 112 secured on the inner mandrel assembly. This engagement prevents subsequent downward displacement of the outer housing assembly 48 relative to the inner mandrel assembly 36.

Due to the upward displacement of the outer housing assembly 48 relative to the inner mandrel assembly 36, the radial expansion mechanism 66 is longitudinally extended to its FIG. 4A radially retracted configuration. This allows the annular seals 28*a,b* and the anti-extrusion barriers 64*a,b* to retract radially inward with the segments 66*a,b* of the radial expansion mechanism 66.

Note that, due to the engagement between the externally toothed surface 114 and the collets 116, the upper inner sleeve 68*a* initially displaces upward with the lower section 48*b* of the outer housing assembly 48. The upper expansion cone 98 displaces upward with the upper inner sleeve 68*a*, thereby also upwardly displacing the upper segments 66*a* and longitudinally extending the radial expansion mechanism 66 to its FIG. 4A radially retracted configuration. When a sufficient upward force is applied due to full longitudinal extension of the radial expansion mechanism 66, the release members 118 shear or otherwise release, thereby permitting the outer housing assembly 48 to displace upward relative to the collets 116, and permitting further upward displacement of the outer housing assembly 48 relative to the radial expansion mechanism.

The upper annular seal 28*a* and the upper anti-extrusion barrier 64*a* displace upward with the outer housing assembly 48, so that they no longer outwardly overlie the radial expansion mechanism 66. Similarly, the lower annular seal 28*b* and the lower anti-extrusion barrier 64*b* no longer outwardly overlie the radial expansion mechanism 66 as it is longitudinally extended and displaced upward with the outer housing assembly 48.

After the radial expansion mechanism 66 is radially retracted and the annular seals 28*a,b* and the anti-extrusion barriers 64*a,b* no longer encircle the radial expansion mechanism, a sufficient upwardly directed force applied to the outer housing 74 (via the retrieval sleeve 110, the outer housing assembly 48 and the radial expansion mechanism 66) causes the release members 92 to shear or otherwise release, thereby permitting the outer housing 74 to displace upward relative to the upper wedge 88. This longitudinally separates the retainer sleeve extension 96 from the body lock ring 94, and thereby permits the upper wedge 88 to displace upward relative to the inner mandrel assembly 36.

As a result, a longitudinal distance between the upper and lower wedges 88, 86 increases, thereby permitting the springs 90 to retract the slips 84 out of engagement with the inner surface of the wellbore 12. At this point, the well tool 24 is completely unset and it can be retrieved from the wellbore 12.

In the event that any of the annular seals 28*a,b* or anti-extrusion barriers 64*a,b* do not fully retract after having been radially extended, these components can be forced back to their retracted configurations as the well tool 24 is retrieved upwardly through the restriction 18. This is possible because the annular seals 28*a,b* and the anti-extrusion barriers 64*a,b* are no longer radially outwardly overlying the radial expansion mechanism 66, but are instead longitudinally spaced apart from the radial expansion mechanism in the unset retrieval configuration of the well tool 24.

In some examples, it may be desirable to not include the lower annular seal 28*b* or the lower anti-extrusion barrier 64*b* in the well tool 24, if it is determined that they are not needed for the expected pressure differential across the well tool and their upwardly facing configuration would possibly present a problem with retrieving the well tool upward through a tight restriction. Thus, the scope of this disclosure is not limited to use of both of the upper and lower annular seals 28*a,b* or both of the upper and lower anti-extrusion barriers 64*a,b*. In one example, the lower annular seal 28*b* could be used without the lower anti-extrusion barrier 64*b*, even though the upper anti-extrusion barrier 64*a* is used with the upper annular seal 28*a*.

In some situations, retrieval of the well tool 24 may be prevented for any of a variety of reasons. For such situations, the well tool 24 includes provisions whereby at least an upper portion of the well tool can be retrieved, separate from a lower portion of the well tool.

Specifically, upper and lower portions of the outer housing assembly lower section 48*a* are releasably connected by means of release members 120 (such as, shear pins or screws, a shear ring, etc.). In addition, a weakened area 58 (such as, a recess or reduced wall thickness area) is provided in the inner mandrel assembly 36. If sufficient tensile forces are applied to the outer housing assembly 48 and the inner mandrel assembly 36 (such as, via a fishing tool), the release members 120 will shear or otherwise release, and the weakened area 58 will part, thereby allowing retrieval of an upper portion of the well tool 24 from the well.

It may now be fully appreciated that the above disclosure provides significant advancements to the arts of designing, constructing and utilizing well tools (such as, plugs and packers) for subterranean wells. In examples described above, the well tool 24 can achieve relatively high radial expansion of the annular seals 28*a,b* when set, while still permitting the well tool to be conveyed through a relatively small restriction 18 in the wellbore 12. The well tool 24 can subsequently be unset and retrieved through the restriction 18, if necessary.

A well tool 24 for use in a subterranean well is provided to the art by the above disclosure. In one example, the well tool 24 can comprise an annular seal 28*a,b* and a radial expansion mechanism 66 having radially retracted and radially expanded configurations. The annular seal 28*a,b* is longitudinally displaceable relative to the radial expansion mechanism 66 in the radially retracted configuration of the radial expansion mechanism 66.

In any of the examples described herein, the radial expansion mechanism 66 may be displaceable to the radially expanded configuration only after the annular seal 28*a,b* radially outwardly encircles the radial expansion mechanism 66.

In any of the examples described herein, the annular seal 28*a,b* may be longitudinally displaceable from a first position in which the annular seal 28*a,b* is longitudinally spaced apart from the radial expansion mechanism 66 to a second position in which the annular seal 28*a,b* overlies the radial expansion mechanism 66.

In any of the examples described herein, the annular seal 28*a,b* may displace from the first position to the second position in response to relative displacement between an inner mandrel assembly 36 and a setting sleeve 32 of the well tool 24.

In any of the examples described herein, the well tool 24 may include an anti-extrusion barrier 64*a,b* which is longitudinally displaceable with the annular seal 28*a,b*.

In any of the examples described herein, the anti-extrusion barrier 64*a,b* may expand radially outward in response to displacement of the annular seal 28*a,b* and the anti-extrusion barrier 64*a,b* relative to the radial expansion mechanism 66.

In any of the examples described herein, the radial expansion mechanism 66 may comprise multiple circumferentially distributed segments 66*a,b*, and the radial expansion mechanism 66 may translate between the radially retracted and radially expanded configurations in response to relative longitudinal displacement between first and second sets of the segments 66*a,b*.

A method of setting a well tool 24 in a subterranean well is also provided to the art by the above disclosure. In one example, the method can comprise: positioning the well tool 24 in the subterranean well, the well tool 24 comprising an annular seal 28*a,b* and a radial expansion mechanism 66, and then longitudinally displacing the annular seal 28*a,b* to a radially outward position relative to the radial expansion mechanism 66.

In any of the examples described herein, the method may include, after the longitudinally displacing step, radially expanding the radial expansion mechanism 66, thereby radially outwardly displacing the annular seal 28*a,b* into sealing contact with a wellbore 12.

In any of the examples described herein, the radially outwardly displacing step may include longitudinally displacing a first set of segments 66*a* of the radial expansion mechanism 66 relative to a second set of segments 66*b* of the radial expansion mechanism 66.

In any of the examples described herein, the method may include grippingly engaging an anchor mechanism 30 of the well tool 24 with the wellbore 12 prior to the radially expanding step.

In any of the examples described herein, the method may include radially outwardly displacing an anti-extrusion barrier 64*a,b* prior to the radially expanding step and after the longitudinally displacing step.

In any of the examples described herein, the method may include longitudinally displacing an anti-extrusion barrier 64*a,b* with the annular seal 28*a,b* relative to the radial expansion mechanism 66.

In any of the examples described herein, the longitudinally displacing step may include longitudinally displacing the annular seal 28*a,b* from a first position in which the annular seal 28*a,b* is longitudinally spaced apart from the radial expansion mechanism 66 to a second position in which the annular seal 28*a,b* at least partially overlies the radial expansion mechanism 66.

Also described above is a well system 10 for use with a subterranean well. In one example, the well system 10 can comprise a well tool 24 positioned in a wellbore 12 of the subterranean well, the well tool 24 comprising an annular seal 28*a,b*, a radial expansion mechanism 66, an inner mandrel assembly 36 and a setting sleeve 32. A setting tool 22 produces a relative longitudinal displacement between the setting sleeve 32 and the inner mandrel assembly 36. The annular seal 28*a,b* radially outwardly overlies the radial expansion mechanism 66 in response to the relative longitudinal displacement.

In any of the examples described herein, the radial expansion mechanism 66 may have radially retracted and radially expanded configurations, and the annular seal 28*a,b* may be longitudinally displaceable relative to the radial expansion mechanism 66 in the radially retracted configuration.

In any of the examples described herein, the radial expansion mechanism 66 may be displaceable to the radially expanded configuration only after the annular seal 28*a,b* radially outwardly overlies the radial expansion mechanism 66.

In any of the examples described herein, the annular seal 28*a,b* may be longitudinally displaceable by the setting tool 22 from a first position in which the annular seal 28*a,b* is longitudinally spaced apart from the radial expansion mechanism 66 to a second position in which the annular seal 28*a,b* radially overlies the radial expansion mechanism 66.

In any of the examples described herein, the well tool 24 may include an anti-extrusion barrier 64*a,b* which is longitudinally displaceable with the annular seal 28*a,b*.

In any of the examples described herein, the anti-extrusion barrier 64*a,b* may expand radially outward in response to displacement of the annular seal 28*a,b* and the anti-extrusion barrier 64*a,b* relative to the radial expansion mechanism 66.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool for use in a subterranean well, the well tool comprising:

an annular seal; and a radial expansion mechanism having radially retracted and radially expanded configurations, the annular seal being longitudinally displaceable relative to the radial expansion mechanism in the radially retracted configuration, in which the radial expansion mechanism comprises multiple circumferentially distributed segments, and in which the radial expansion mechanism translates between the radially retracted and radially expanded configurations in response to relative longitudinal displacement between first and second sets of the segments.

2. The well tool of claim 1, in which the radial expansion mechanism is displaceable to the radially expanded configuration only after the annular seal radially outwardly encircles the radial expansion mechanism.

3. The well tool of claim 1, in which the annular seal is longitudinally displaceable from a first position in which the annular seal is longitudinally spaced apart from the radial expansion mechanism to a second position in which the annular seal overlies the radial expansion mechanism.

4. The well tool of claim 3, in which the annular seal displaces from the first position to the second position in response to relative displacement between an inner mandrel assembly and a setting sleeve of the well tool.

5. The well tool of claim 1, further comprising an anti-extrusion barrier which is longitudinally displaceable with the annular seal.

6. The well tool of claim 5, in which the anti-extrusion barrier expands radially outward in response to displacement of the annular seal and the anti-extrusion barrier relative to the radial expansion mechanism.

7. A method of setting a well tool in a subterranean well, the method comprising:

positioning the well tool in the subterranean well, the well tool comprising an annular seal and a radial expansion mechanism;

then longitudinally displacing the annular seal to a radially outward position relative to the radial expansion mechanism; and then radially expanding the radial expansion mechanism, thereby radially outwardly displacing the annular seal into sealing contact with a wellbore, in which the radially outwardly displacing step comprises longitudinally displacing a first set of segments of the radial expansion mechanism relative to a second set of segments of the radial expansion mechanism.

8. The method of claim 7, further comprising grippingly engaging an anchor mechanism of the well tool with the wellbore prior to the radially expanding step.

9. The method of claim 7, further comprising radially outwardly displacing an anti-extrusion barrier prior to the radially expanding step and after the longitudinally displacing step.

10. The method of claim 7, further comprising longitudinally displacing an anti-extrusion barrier with the annular seal relative to the radial expansion mechanism.

11. The method of claim 7, in which the longitudinally displacing step comprises longitudinally displacing the annular seal from a first position in which the annular seal is longitudinally spaced apart from the radial expansion mechanism to a second position in which the annular seal at least partially overlies the radial expansion mechanism.

12. A well system for use with a subterranean well, the well system comprising:

a well tool positioned in a wellbore of the subterranean well, the well tool comprising an annular seal, a radial expansion mechanism, an inner mandrel assembly and a setting sleeve;

a setting tool that produces a relative longitudinal displacement between the setting sleeve and the inner mandrel assembly, the annular seal radially outwardly overlying the radial expansion mechanism in response to the relative longitudinal displacement; and an unsetting tool that radially retracts the well tool, thereby permitting retrieval of the well tool after the well tool has been set by the setting tool.

13. The well system of claim 12, in which the radial expansion mechanism has radially retracted and radially expanded configurations, and the annular seal is longitudinally displaceable relative to the radial expansion mechanism in the radially retracted configuration.

14. The well system of claim 13, in which the radial expansion mechanism is displaceable to the radially expanded configuration only after the annular seal radially outwardly overlies the radial expansion mechanism.

15. The well system of claim 12, in which the annular seal is longitudinally displaceable by the setting tool from a first position in which the annular seal is longitudinally spaced apart from the radial expansion mechanism to a second position in which the annular seal radially overlies the radial expansion mechanism.

16. The well system of claim 12, in which the well tool further comprises an anti-extrusion barrier which is longitudinally displaceable with the annular seal.

17. The well system of claim 16, in which the anti-extrusion barrier expands radially outward in response to displacement of the annular seal and the anti-extrusion barrier relative to the radial expansion mechanism.

* * * * *